US009988749B2

(12) United States Patent
Sim

(10) Patent No.: US 9,988,749 B2
(45) Date of Patent: Jun. 5, 2018

(54) UNDER-THREAD SUPPLY DEVICE FOR SEWING MACHINE

(71) Applicant: SINJINSTEEL CO., LTD, Ansan-si, Gyeonggi-do (KR)

(72) Inventor: Young Gun Sim, Seoul (KR)

(73) Assignee: SINJINSTEEL CO., LTD, Ansan-si, Gyeonggi-do (KR)

( * ) Notice: Subject to any disclaimer, the term of this patent is extended or adjusted under 35 U.S.C. 154(b) by 457 days.

(21) Appl. No.: 14/443,000

(22) PCT Filed: Nov. 20, 2012

(86) PCT No.: PCT/KR2012/009813

§ 371 (c)(1),
(2) Date: May 14, 2015

(87) PCT Pub. No.: WO2014/077440

PCT Pub. Date: May 22, 2014

(65) Prior Publication Data

US 2015/0292130 A1 Oct. 15, 2015

(30) Foreign Application Priority Data

Nov. 16, 2012 (KR) ..... 10-2012-0130589

(51) Int. Cl.
*D05B 57/14* (2006.01)
*D05B 57/26* (2006.01)
*D05B 59/00* (2006.01)

(52) U.S. Cl.
CPC ..... *D05B 57/26* (2013.01); *D05B 57/14* (2013.01); *D05B 59/00* (2013.01)

(58) Field of Classification Search
CPC ..... D05B 57/14; D05B 57/26; D05B 59/00
USPC ..... 112/231–232
See application file for complete search history.

(56) References Cited

U.S. PATENT DOCUMENTS 3,596,619 A 8/1971 Winberg
5,921,192 A * 7/1999 Badillo ..... D05B 57/265 112/231

(Continued)

FOREIGN PATENT DOCUMENTS

CN 1721607 A 1/2006
JP 45-13661 B 5/1970

(Continued)

OTHER PUBLICATIONS

Japanese Office Action dated May 31, 2016 from JPO in connection with the counterpart Japanese Patent Application No. 2015-542922, citing the above reference(s).

(Continued)

*Primary Examiner* — Nathan Durham
(74) *Attorney, Agent, or Firm* — Hauptman Ham, LLP

(57) ABSTRACT

The present invention relates to an under-thread supply device for a sewing machine, and more particularly, to an enhanced under-thread supply device for a sewing machine, in which the device of the present invention and a unit for mounting said device are just partially changed so as to increase the winding amount of the under-thread of conventional sewing machines in order to achieve improved efficiency of sewing and efficiently reduce the puckering of a work piece without causing changes in the basic structure of conventional sewing machines.

11 Claims, 16 Drawing Sheets

(56) References Cited

U.S. PATENT DOCUMENTS

| | | | | | |
|---|---|---|---|---|---|
| 5,960,728 | A * | 10/1999 | Hirose | D05B 57/14 | 112/231 |
| 6,076,477 | A * | 6/2000 | Badillo | D05B 57/14 | 112/231 |
| 2003/0167989 | A1 * | 9/2003 | Lee | D05B 57/26 | 112/231 |
| 2007/0095263 | A1 * | 5/2007 | Sakuma | D05B 57/14 | 112/188 |
| 2010/0107948 | A1 * | 5/2010 | Totsu | B65H 49/38 | 112/231 |

FOREIGN PATENT DOCUMENTS

| | | | |
|---|---|---|---|
| JP | 06292780 | A | 10/1994 |
| JP | 2009106430 | A | 5/2009 |
| KR | 1020060083278 | A | 7/2006 |
| KR | 100740523 | B1 | 7/2007 |
| KR | 20110003701 | A | 1/2011 |
| WO | 2005095702 | A1 | 10/2005 |
| WO | 2006004243 | A1 | 1/2006 |

OTHER PUBLICATIONS

Extended European Search Report dated Nov. 2, 2015 in connection with the counterpart European Patent Application No. 12888495.4, citing the above reference(s).

Chinese Office Action dated Dec. 21, 2015 in connection with the counterpart Chinese Patent Application No. 201280077142.7, citing the above reference(s).

International Search Report for PCT/KR2012/009813 dated May 15, 2013, citing the above reference(s).

* cited by examiner

UNDER-THREAD SUPPLY DEVICE FOR SEWING MACHINE

CROSS REFERENCE TO RELATED APPLICATION

This application claims the priority of Korean Patent Application No. 10-2012-0130589 filed on Nov. 16, 2012 in the Korean Patent and Trademark Office. Further, this application is the National Phase application of International Application No. PCT/KR2012/009813 filed on Nov. 20, 2012, which is incorporated herein by reference in its entirety.

TECHNICAL FIELD

The present invention relates to an under-thread supply device for a sewing machine, and more particularly, to an advanced under-thread supply device for a sewing machine, which is intended to increase the winding amount of under-thread of conventional sewing machines merely by partially changing an under-thread supply device of the sewing machine and a mounting portion thereof without changing the basic structure of the conventional sewing machines, thus enhancing sewing efficiency and efficiently reducing the puckering of a sewn product.

BACKGROUND ART

A sewing machine is a machine that is used to mechanically sew clothes, bags, shoes, and other sewn products, thus allowing them to be rapidly and easily made.

However, a person adjusting the sewing machine is eventually responsible for moving a sewn product, performing a sewing operation (backstitch; the same applies to the following) along a sewing line, or adjusting the sewing machine in sewing work. Thus, the efficiency of the sewing work depends on the efficiency of the sewing machine.

The basic principle of the sewing machine is as follows: under thread is provided and upper thread is pulled, so that the under thread is interwoven with the upper thread by a mechanical operation, thus making stitches on a sewn product. Particularly, an under-thread supply device for a sewing machine is the most important element in the sewing machine. The amount of the under thread provided in the sewing machine is the most important factor in determining the continuity of the sewing work, and influences the sewing efficiency. Therefore, many efforts are being made to increase the winding amount of the under thread of the sewing machine.

Nevertheless, it is believed that the width, length, and height of a current sewing machine are gradually developed to be optimal for doing the sewing work from an ergonomic point of view. Hence, those skilled in the art hesitate to change the basic structure of the sewing machine. Consequently, the development of the under-thread supply device that is a component of the sewing machine also has some limitations.

Therefore, a rotary shuttle device, which is the conventional under-thread supply device for the sewing machine, has a drawback in that the amount of the under thread provided in the device is very little, so that the under thread should be frequently replenished or replaced during sewing work. Therefore, the sewing work does not maintain continuity but is frequently interrupted, thus leading to a reduction in efficiency of the sewing work.

Further, the sewing machine consumes the upper thread of a predetermined length during a thread take-up process. In order to form the stitch on the sewn product, the upper thread should be pulled and tightened by a thread take-up lever. As a result, fine puckering (phenomenon in which the sewn product is creased or shrunk) may inevitably occur in the sewn product. Even if it is difficult to completely overcome this problem due to the properties of cloth that is the sewn product, many attempts are currently made to find a way to reduce the puckering.

A sewing process using a rotary shuttle device that is the conventional under-thread supply device for the sewing machine will be described below in brief with reference to FIG. 17.

As shown in FIG. 17, in an upper portion of the sewing machine, a needle 1 in which upper thread 12 is fitted passes through a sewn product 2 and moves up and down to a bed portion at a lower position. In the bed portion located at the lower position of the sewing machine, a hook body 3 having a hook for catching the upper thread 12 continues to rotate. A bobbin case base 4 is mounted in the hook body 3 in such a way as to rotatably accommodate a bobbin (not shown) around which the under thread 11 is wound. The bobbin case base 4 discharges the under thread 11 to the outside through an under-thread discharge hole (not shown).

As shown in FIG. 17(1) to FIG. 17(5), if the needle 1 with the upper thread 12 passes through the sewn product 2 and moves down to the bed portion as shown in FIG. 17(1), the upper thread 12 having a length of one stitch is unwound and supplied from an upper-thread spool (not shown). Thus, at the moment when the needle 1 moves up, an upper-thread loop 12' is formed at a tip of the needle as shown in FIG. 17(2) due to a frictional force between the upper thread 12 and the sewn product 2.

If the hook body 3 rotates with the upper-thread loop 12' being caught by the hook as shown in FIG. 17(3), the upper-thread loop 12' surrounds and turns around the bobbin case base 4 as shown in FIG. 17(4). When the hook goes beyond a half region of a lower outer periphery of the bobbin case base 4, the upper-thread loop 12' is removed from the hook and moves to an opposite side of the bobbin case base 4 as shown in FIG. 17(5) to be interwoven with the under thread 11 discharged from the bobbin case base 4. If the upper-thread loop 12' is pulled to become small by the upwardly moving needle 1 and then is tightened by a thread take-up lever (not shown) to form a stitch on the sewn product 2, a toothed portion (not shown) pushes the sewn product 2 by a predetermined width. While the above-described process is repeated, the sewn product 2 is sewn (backstitched).

That is, the conventional sewing machine is configured such that the upper thread of one side inserted into a hole of the thread take-up lever pulls the upper thread wound around the upper-thread spool under a predetermined tension to cause the upper thread of a length required to form one stitch to be unwound from the upper-thread spool, by the thread take-up process, and the upper thread of the other side inserted into the hole of the thread take-up lever pulls the upper thread interwoven with the under thread under a predetermined tension, thus forming one stitch on cloth that is the sewn product.

Here, gaps are inevitably present between strands of the cloth that is the sewn product. The predetermined tension acting on the upper thread of the other side pulls the strands of the cloth that is the sewn product and eliminates the gaps between the strands, thus causing an imbalance in tension between the upper thread and the under thread and thereby leading to defective sewing, such as the puckering occurring in the sewn product. These problems should be urgently addressed.

DISCLOSURE

Technical Problem

Accordingly, the present invention has been made keeping in mind the above problems occurring in the related art, and is intended to provide an advanced under-thread supply device for a sewing machine, which is configured to increase the winding amount of under-thread of conventional sewing machines merely by partially changing an under-thread supply device of the sewing machine and a mounting portion thereof without changing the basic structure of the conventional sewing machines, thus enhancing sewing efficiency and efficiently reducing the puckering of a sewn product.

Technical Solution

In an aspect, the present invention provides a under-thread supply device for a sewing machine, including a hook unit (1) having a body hook (200) rotatably mounted therein, the body hook discharging under thread (11) and passing directly through an upper-thread loop (12') to interweave the under thread (11) with upper thread (12) so as to form a stitch on a sewn product; and an under-thread unit (2) having an U-shaped bobbin (400) mounted thereon and inserted into an under-thread receiving portion (207) of the body hook (200), the U-shaped bobbin having an under-thread bundle (11') seated in an U-shaped bobbin case (500) to supply the under thread (11) for forming the stitch on the sewn product.

Further, the hook unit (1) may include a power actuator (100) receiving power from a power transmission shaft (not shown) of a conventional sewing machine, and rotating a rotating shaft (130) by gear driving using the power, thus rotatably driving a power ring (150) coupled with the rotating shaft (130) via a link (140); a body hook (200) rotated by rotating power transmitted from the power ring (150) of the power actuator (100), and passing directly through the upper-thread loop (12') with the under-thread unit (2) received therein, thus interweaving the under thread (11) with the upper thread (12); and a coupling member (300) coupling the power actuator (100) with the body hook (200).

Furthermore, the under-thread unit (2) may include an U-shaped bobbin (400) seating the under-thread bundle (11') therein and mounted in the U-shaped bobbin case (500); and the U-shaped bobbin case (500) accommodating the U-shaped bobbin (400) in which the under-thread bundle (11') is seated, and inserted into the under-thread receiving portion (207) of the body hook (200).

Advantageous Effects

As described above, the advanced under-thread supply device for the sewing machine according to the present invention is configured to increase the winding amount of under-thread of conventional sewing machines merely by partially changing the under-thread supply device of the sewing machine and the mounting portion thereof without changing the basic structure of the conventional sewing machines, thus enhancing the sewing efficiency and efficiently reducing the puckering of the sewn product.

DESCRIPTION OF DRAWINGS

FIG. 6(2) is a view illustrating a central power protrusion 155 of a power ring 150;

DESCRIPTION OF REFERENCE NUMERALS OF IMPORTANT PARTS

Figure 1:
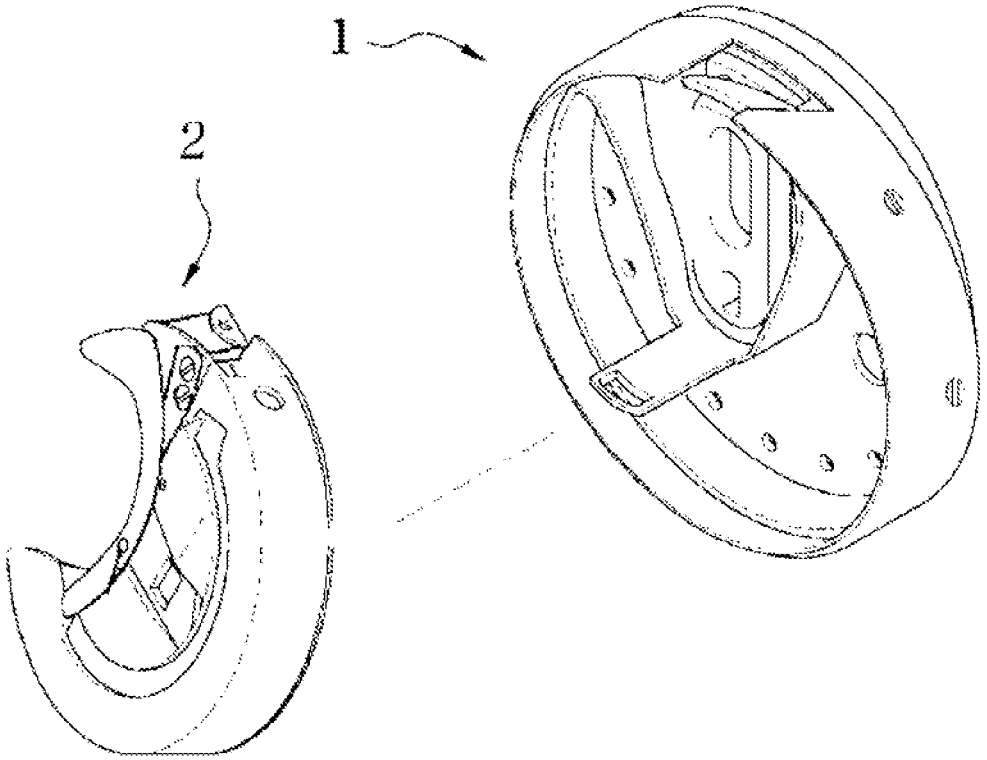
FIG. 1 is an exploded perspective view showing an under-thread supply device for a sewing machine according to the present invention.

A: under-thread supply device for sewing machine 11: under thread 11': under-thread bundle 11*a*: winding shaft 11*b*: end of thread 12: upper thread 12': upper-thread loop C1: first coupling body C2: second coupling body

1: hook unit

100: power actuator

110: housing 110*a*: outer circumference 110*b*: closed spherical surface 110*c*: opening

111: rotating-shaft coupling hole 112: receiving-shaft receiving portion 113: receiving-shaft coupling hole 114: fixed-plate fixing hole 115: coupling-flange coupling hole 116: upper-thread gate 117: fixing protrusion 118: cutout portion 119: opening end

120: shaft 121: hollow portion 122: transmission gear 123: inertia portion 124: coupling shaft 125: fastening hole 126: fastening bolt

130: rotating shaft 131: rotary gear 132: coupling shaft 133: straight protrusion

140: link 141: weight-reduction hole 142: straight-protrusion coupling hole 143: coupling hole

150: power ring 151: inner surface 152: outer surface 153: rotation guide 154: link coupler 155: power protrusion

160: fixed plate 161: rotating-shaft receiving portion 161': rotating-shaft coupling hole 162: receiving-shaft receiving portion 162': receiving-shaft coupling hole 163: rotation-guide guiding portion 164: compressing portion 165: fastening hole 166: fastening bolt

200: body hook

201: outer circumference 202: cavity 203: hook 204: rear portion 205: binding bar 205': outer wall surface 206: wall 207: under-thread receiving portion 208: power protrusion inlet/outlet hole 209: projecting bar 210: opening 211: upper-thread slide line 212: weight-reduction hole 213: step 214: housing inserting portion 215: coupling-flange holding portion

300: coupling member 310: coupling flange 311: locking step 312: upper-thread gate 313 fixing-protrusion inserting recess 314: coupling hole 320: coupling bolt

2: under-thread unit

400: U-shaped bobbin 410: U-shaped body 411: bottom plate 412: outer wall 413: seating-wall coupling hole

420: under-thread-bundle seating wall 421: coupling protrusion

500: U-shaped bobbin case

510: left case 511: left cover 511*a*: U-shaped elongated hole 511*b*: member coupling portion 511*c*: protective wall 511*d*: hinge protrusion 511*e*: hinge-shaft coupling hole 512: tension adjusting piece 513: binding portion 513*a*: under-thread guide piece 513*b*: elongate under-thread guide groove 513*c*: under-thread stopping hole 514: under-thread-discharge-hole aligning bar 514*a*: under-thread guide pin 514*b*: under-thread guide groove 514*c*: under-thread discharge hole

520: right case 521: right cover 521*a*: bent portion 521*b*: elastic piece 521*c*: hinge shaft 522: under-thread-bundle protective wall 523: seating portion

BEST MODE

Hereinbelow, the configuration and operation of an under-thread supply device A for a sewing machine according to the present invention will be described in detail with reference to the accompanying drawings.

The terminologies or words used in the description and the claims of the present invention should not be interpreted as being limited merely to their common and dictionary meanings. On the contrary, they should be interpreted based on the meanings and concepts of the invention in keeping with the scope of the invention based on the principle that the inventor(s) can appropriately define the terms in order to describe the invention in the best way. It is to be understood that the form of my invention shown and described herein is to be taken as a preferred embodiment of the present invention and that various changes and modifications may be made in the invention without departing from the spirit and scope thereof. Further, in the following description, it is to be noted that, when the functions of conventional elements and the detailed description of elements related with the present invention may make the gist of the present invention unclear, a detailed description of those elements will be omitted. Wherever possible, the same reference numerals will be used throughout the drawings to refer to the same or like parts.

Further, an under-thread supply device for a sewing machine according to the present invention is intended to use the basic structure of conventional sewing machines simply by partially changing a mounting portion without completely changing the basic structure, thus increasing the winding amount of under-thread of the conventional sewing machines and reducing puckering, and thereby enhancing sewing efficiency. In the description of this embodiment, terms, "conventional sewing machine", "prior hook body", and "prior bobbin case base" are used to help readers understand the present invention, but they are not illustrated in the drawings.

FIG. 1 is an exploded perspective view showing an under-thread supply device for a sewing machine according to the present invention.

As shown in FIG. 1, the under-thread supply device A for the sewing machine includes a hook unit 1 and an under-thread unit 2. The hook unit 1 has a body hook 200 rotatably mounted therein. The body hook discharges under thread 11 and passes directly through an upper-thread loop 12' to interweave the under thread 11 with upper thread 12 so as to form a stitch on a sewn product. The under-thread unit has an U-shaped bobbin 400 mounted thereon and is inserted into an under-thread receiving portion 207 of the body hook 200. The U-shaped bobbin has an under-thread bundle 11' seated in an U-shaped bobbin case 500 to supply the under thread 11 for forming the stitch on the sewn product.

Further, the hook unit 1 includes a power actuator 100, a body hook 200, and a coupling member 300. The power actuator receives power from a power transmission shaft (not shown) of a conventional sewing machine, and rotates a rotating shaft 130 by gear driving using the power, thus rotatably driving a power ring 150 coupled with the rotating shaft 130 via a link 140. The body hook is rotated by rotating power transmitted from the power ring 150 of the power actuator 100, and passes directly through the upper-thread loop 12' with the under-thread unit 2 received therein, thus interweaving the under thread 11 with the upper thread 12. The coupling member couples the power actuator 100 with the body hook 200.

Further, the under-thread unit 2 includes an U-shaped bobbin 400 which seats the under-thread bundle 11' therein and is mounted in the U-shaped bobbin case 500, and the U-shaped bobbin case 500 which accommodates the U-shaped bobbin 400 in which the under-thread bundle 11' is seated, and is inserted into the under-thread receiving portion 207 of the body hook 200.

Such a configuration will be described below in detail.

Figure 2:
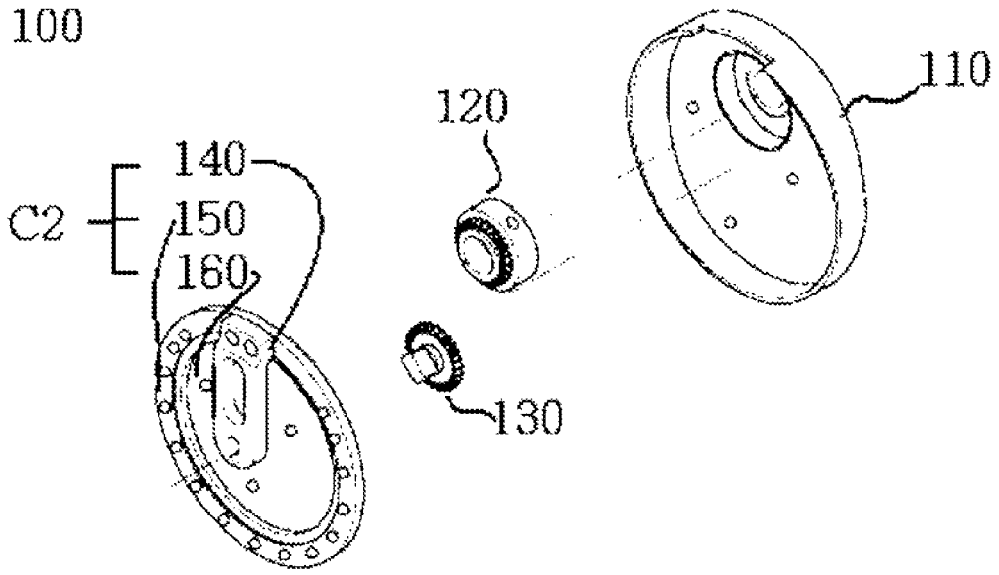
FIG. 2 is an exploded perspective view showing a power actuator 100 according to the present invention.

FIG. 2 is an exploded perspective view showing the power actuator 100 according to the present invention.

First, the power actuator 100 integrally includes a housing 110, a receiving shaft 120 receiving power from a power transmission shaft (not shown) of the conventional sewing machine, a rotating shaft 130 rotated by gear driving with the receiving shaft 120, a link 140 linking the rotating shaft 130 with the power ring 150, a power ring 150 rotatably coupled to the rotating shaft 130 via the link 140, and a fixed plate 160 rotatably coupling the receiving shaft 120, the rotating shaft 130 and the power ring 150 in a closed spherical surface 110*b* of the housing 110.

Figure 10:
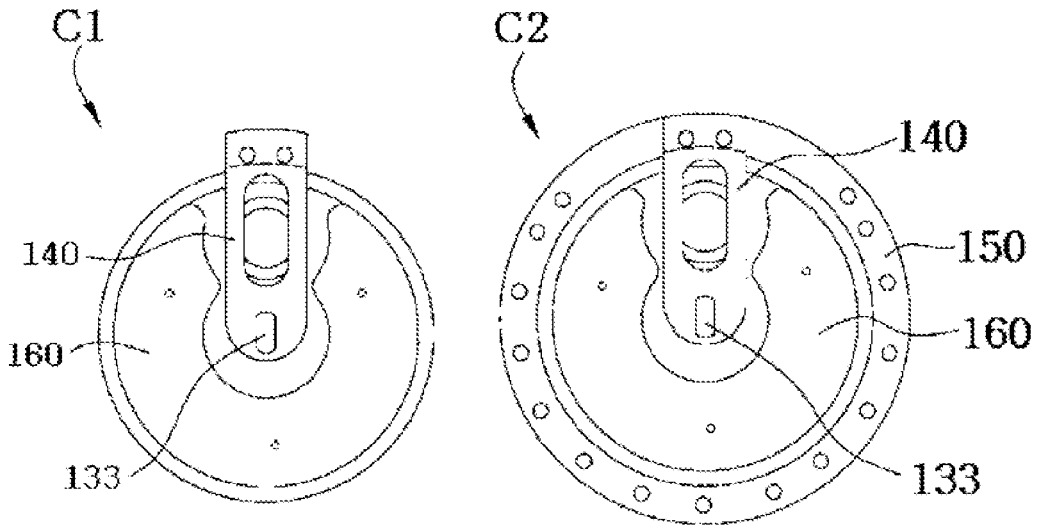
FIG. 10 is a view illustrating a first coupling body C1 and a second coupling body C2 in a coupling process integrally coupled with a fixed plate.

Here, as shown in FIGS. 2 and 10, the rotating shaft 130, the link 140, the power ring 150 and the fixed plate 160 are integrated with each other, thus constituting a second coupling body C2.

Figure 3:
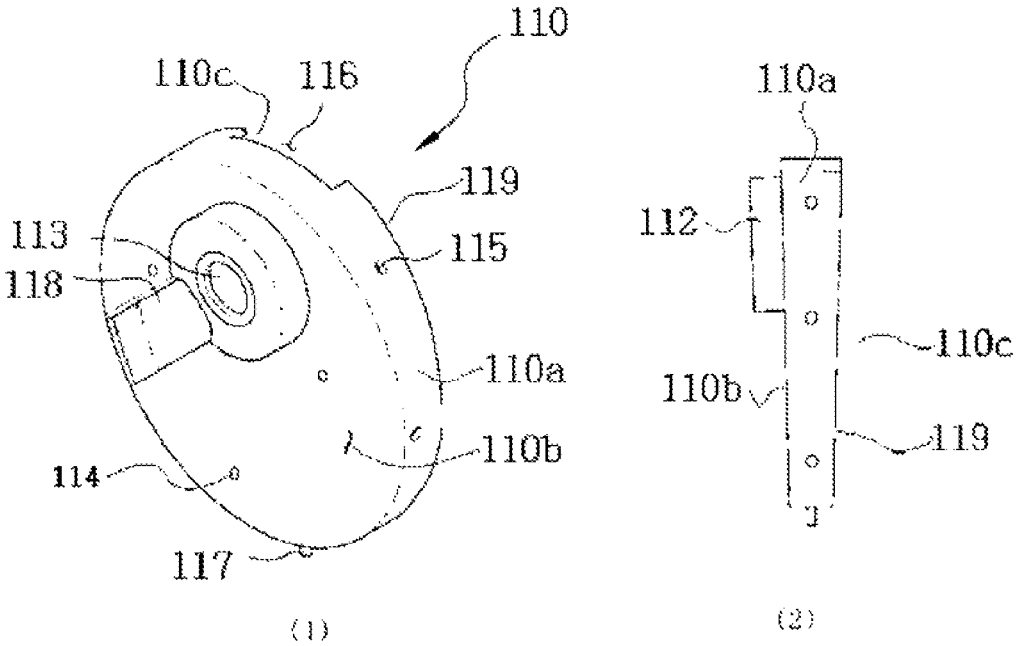
FIG. 3 illustrates a housing 110 of the present invention in a perspective view and a side sectional view.
Figure 4:
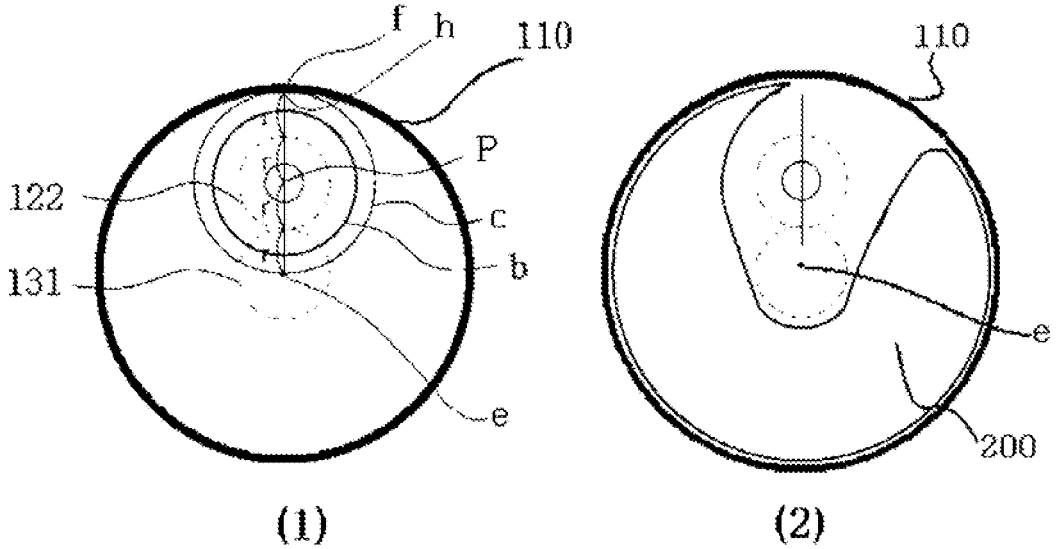
FIG. 4 is a view illustrating an outer diameter of the housing of the present invention and the principle of forming a body hook thereof.
Figure 5:
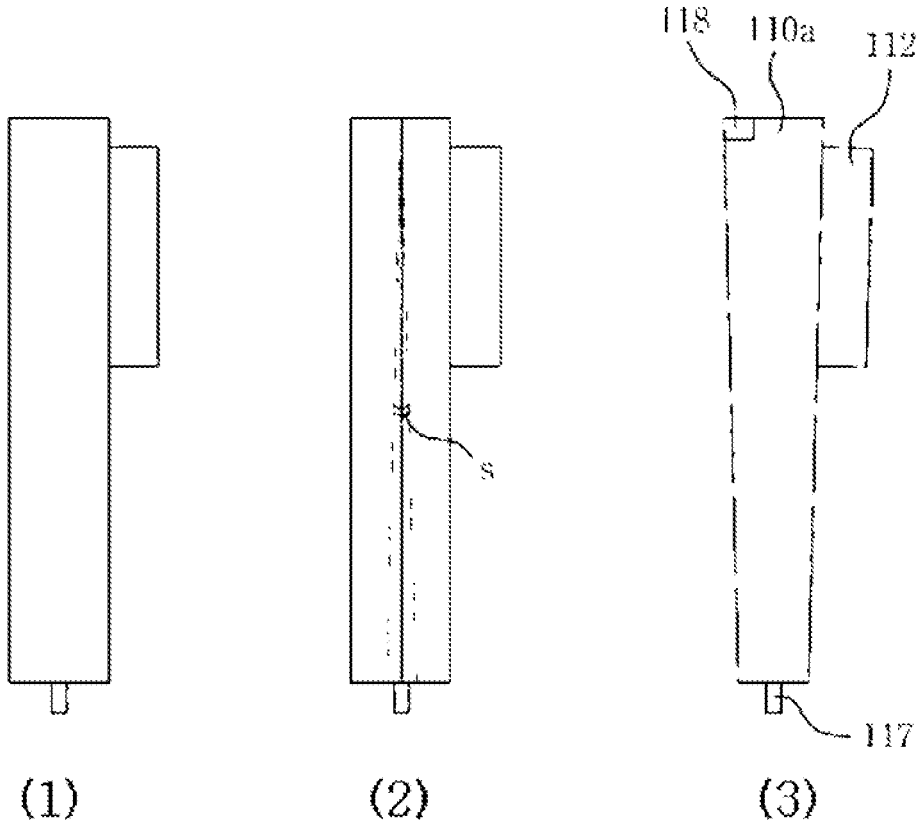
FIG. 5 and FIG. 6(1) are views illustrating the principle of forming an outer circumference 110*a* of the housing according to the present invention.
Figure 6:
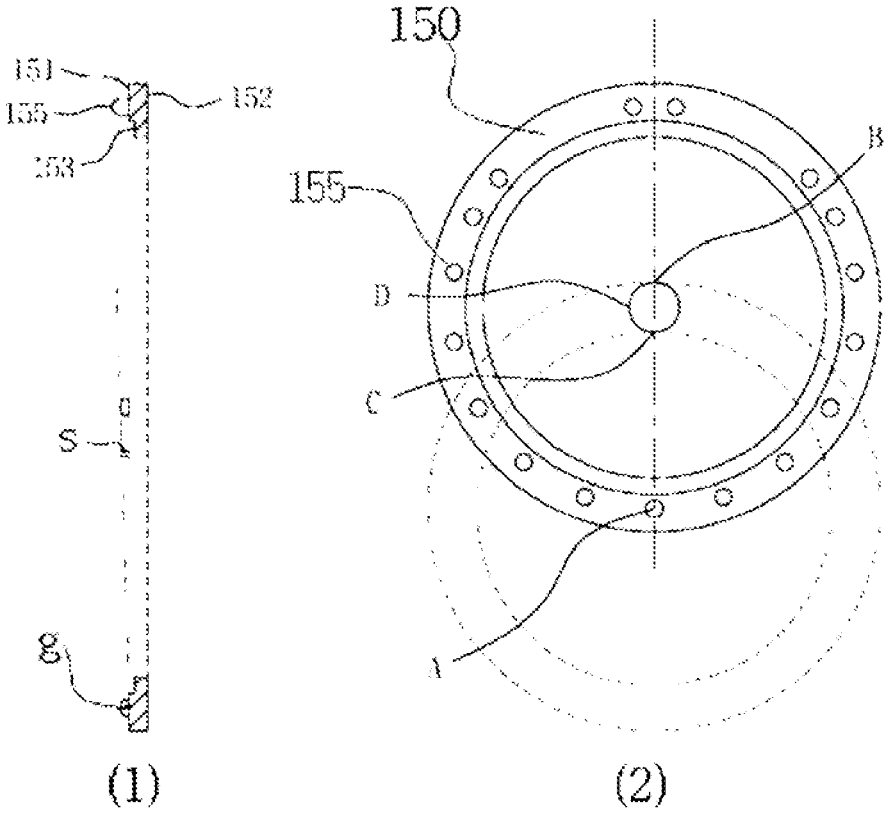

FIG. 3 illustrates the housing 110 of the present invention in a perspective view and a side sectional view, FIG. 4 is a view illustrating an outer diameter of the housing of the present invention and the principle of forming the body hook thereof, FIG. 5 and FIG. 6(1) are views illustrating the principle of forming an outer circumference 110*a* of the housing according to the present invention, and FIG. 6(2) is a view illustrating a central power protrusion 155 of the power ring 150.

The housing 110 is made of a steel material and is shaped into a lateral cylindrical body having an outer circumference 110*a* of a predetermined length, with a closed spherical surface 110*b* formed on a right side and an opening 110*c* formed on a left side, as shown in FIG. 3. They may be formed on the contrary to this.

The outer diameter of the housing 110 is formed as large as possible within a range where the housing is interfered by a toothed-portion moving member (not shown) provided on a lower portion of a bed portion of the conventional sewing machine.

The housing is formed to have a size of a circle that is circumscribed about a central point f on an upper end of an outer diameter of a prior hook body c that has a central point e on a lower end of the outer diameter of the prior hook body c, as shown in FIG. 4(1), as a central point of the rotating shaft 130. Here, the inner diameter of the housing (110) is formed to have a size that allows the body hook 200 to be rotatably inserted therein, as shown in FIG. 4(2).

As shown in FIG. 5(2), the outer circumference 110*a* of the housing 110 is integrally formed by welding facing ends to each other. The ends are formed in an elliptical shape by cutting along diagonal lines that connects an upper-side intersection of a perpendicular line relative to a ½ point in a horizontal direction of the outer circumference 110*a* with intersections spaced apart from a lower-side intersection relative to opposite sides of the perpendicular line by a predetermined length.

As shown in FIG. 6(1), the cutting diagonal lines are diagonal lines formed on left and right sides of the upper-side intersection of the perpendicular line relative to the ½ point in the horizontal direction of the outer circumference 110*a* of the housing 110, as shown in FIG. 5(2), at a half of an angle s between a surface of forming the power protrusion 155 and a line connecting a joining point g of a lowermost power protrusion 155 with an upper end of the central power protrusion 155, at a joining point g of the power protrusion 155 secured to a lowermost position of the power ring 150.

The 'central power protrusion 155' refers to a power protrusion 155 secured in a region (circle shown by an arrow) of the inner surface 151 of the power ring 150 that meets a circle passing an uppermost-end point B and a lowermost-end point C of a trajectory D of an outer wall surface 205' of the binding bar 205 of the body hook 200 that is rotated about the rotating shaft 130 by driving the power actuator 100, with a joining point A of the lowermost power protrusion 155 of the power ring 150 as a center, as shown in FIG. 6(2).

Here, the opening end 119 of the opening 110*c* of the housing 110 maintains a circular shape.

Further, a plurality of coupling-flange coupling holes 115 each having a nut structure is formed through the outer circumference 110*a* of the housing 110. An upper-thread gate 116 is formed by cutting an upper portion on the center of the outer circumference 110*a*, and a fixing protrusion 117 protrudes from a lower portion on the center of the outer circumference 110*a*.

Furthermore, a rotating-shaft coupling hole 111 is formed through a central portion of the closed spherical surface 110*b* of the housing 110. A receiving-shaft receiving portion 112 is formed by boring a circular hole of a predetermined size in a position of the upper region on the center of the closed spherical surface where the power transmission shaft (not shown) of the conventional sewing machine is received, and then welding the opening of the cylindrical body, which is closed at a surface thereof, to the hole (not shown). A receiving-shaft coupling hole 113 is formed through a central portion of the closed spherical surface of the receiving-shaft receiving portion 112. A plurality of fixed-plate fixing holes 114 each having a nut structure is formed at the central region of the closed spherical surface 110*b* of the housing 110 in such a way as to correspond to positions of fastening holes 165 of the fixed plate 160.

The receiving-shaft receiving portion 112 is provided on the closed spherical surface 110*b* of the housing 110, thus ensuring a gap when the under-thread supply device for the sewing machine according to the present invention is mounted to the bed portion (not shown) of the conventional sewing machine, and thereby allowing convenient installing work and obtaining a space for mounting other members therein.

Preferably, an outer portion of the closed spherical surface 110*b* of the housing 110 includes a cutout portion 118 for cooling or supplying oil. The cutout portion is formed by cutting a predetermined region from a side of the receiving-shaft receiving portion 112 to a side of the outer circumference 110*a*, as shown in FIG. 3.

Figure 7:
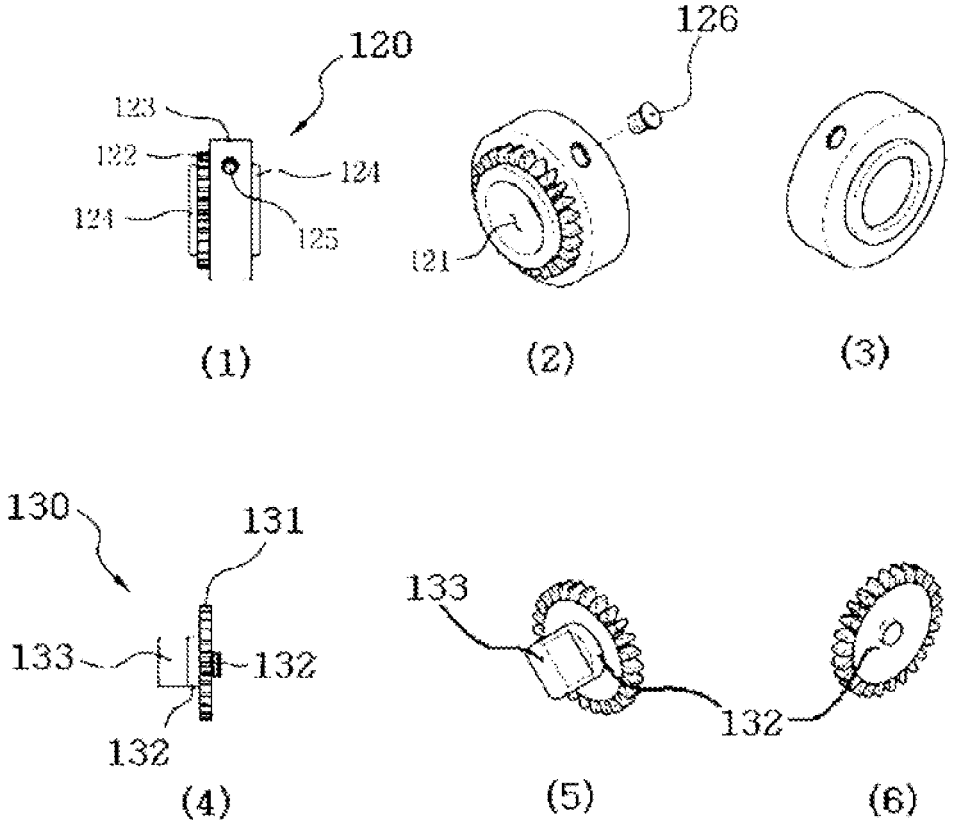
FIGS. 7(1), 7(2) and 7(3) are a sectional perspective view and perspective views showing a side of a receiving shaft, and FIGS. 7(4), 7(5) and 7(6) are a sectional perspective view and perspective views showing a side of a rotating shaft.

FIGS. 7(1), 7(2) and 7(3) are a sectional perspective view and perspective views showing a side of the receiving shaft, and FIGS. 7(4), 7(5) and 7(6) are a sectional perspective view and perspective views showing a side of the rotating shaft The receiving shaft 120 is formed to have a shape of a cylinder that has on a central portion thereof a hollow portion 121 into which the power transmission shaft (not shown) of the conventional sewing machine is inserted. As shown in FIG. 7(1), the receiving shaft integrally includes a transmission gear 122 formed on an outer surface of a cylindrical portion, an inertia portion 123, and coupling shafts 124 provided on both ends thereof.

The receiving shaft 120 is provided with the inertia portion 123, thus ensuring a gap when the under-thread supply device for the sewing machine according to the present invention is mounted to the bed portion (not shown) of the conventional sewing machine, and thereby allowing convenient installing work and obtaining a space for mounting other members therein.

The receiving shaft 120 receives power from the power transmission shaft (not shown) of the conventional sewing machine, and transmits the received power to the rotating shaft 130 by gear driving. Thus, the central point of the receiving shaft 120 coincides with the central point of the power transmission shaft (not shown) of the conventional sewing machine, and corresponds to point P of FIG. 4.

A plurality of fastening holes 125 is formed in an outer circumference of the inertia portion 123 of the receiving shaft 120, each fastening hole having a nut structure to fasten the power transmission shaft (not shown) of the conventional sewing machine to the hollow portion 121. Each fastening hole 125 is provided with a fastening bolt 126.

Further, an inserting end (not shown) of the power transmission shaft of the conventional sewing machine coupled to the hollow portion of the receiving shaft 120 is preferably formed to have the shape of a polyhedron corresponding to the number of the fastening holes 125 formed through the outer circumference of the inertia portion 123, because it can considerably increase coupling friction when the fastening bolt 126 is coupled to an associated fastening hole.

Next, as shown in FIG. 7(4), the rotating shaft 130 integrally includes a rotary gear 131 on a central portion and coupling shafts 132 on central portions of left and right sides of the rotary gear 131, with a straight protrusion 133 extending from the inner coupling shaft 132 to couple the link 140 thereto.

As shown in FIG. 4, the central point of the rotating shaft 130 becomes the central point e on the lower end of the outer diameter of the prior hook body c.

In order to ensure smooth gear driving between the rotating shaft 130 and the receiving shaft 120, the number of teeth and the diameter of the rotary gear 131 of the rotating shaft 130 are identical with those of the transmission gear 122 of the receiving shaft 120.

Thus, assuming that the diameter of the prior hook body is 4r, the radius of the rotary gear 131 of the rotating shaft 130 becomes r, and the radius of the transmission gear 122 of the receiving shaft 120 becomes r as well.

The straight protrusion 133 of the rotating shaft 130 is coupled to a straight-protrusion coupling hole 142 formed in a first end of the link 140 that is coupled at a second end to the power ring 150.

The rotating shaft 130 is rotated by power transmitted from the receiving shaft 120 through gear driving, thus rotating the power ring 150 coupled to the straight protrusion 133 of the coupling shaft 132 via the link 140. That is, if the rotating shaft 130 operated in conjunction with the receiving shaft 120 through the gear driving is rotated, the power ring 150 coupled to the straight protrusion 133 of the coupling shaft 132 via the link 140 is rotated along with the rotating shaft.

Therefore, the body hook 200 of the present invention which is rotatably coupled to the power protrusion 155 of the power ring 150 is rotated in a direction opposite to the rotating direction of the prior hook body, thus interweaving the under thread 11 with the upper thread 12.

The rotating shaft 130 is integrally coupled to the fixed plate 160, which will be described below in detail, together with the link 140 for the convenience of the coupling process, thus constituting coupling bodies of FIGS. 8 and 9.

Figure 8:
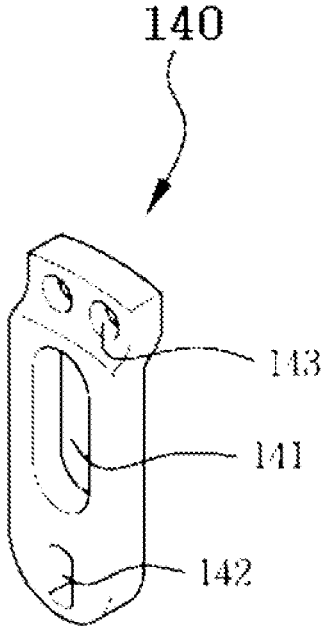
FIG. 8 is a perspective view showing a link 140.

Next, FIG. 8 is a perspective view of the link 140.

The link 140 is formed of a rectangular steel piece, and includes a weight-reduction hole 141 formed through a central portion thereof, a straight-protrusion coupling hole 142 formed through a first end thereof, and a coupling hole 143 formed through a second end thereof. The link is formed to have the shape of "—" so as not to be interfered by the rotating-shaft receiving portion 161 and the receiving-shaft receiving portion 162 of the fixed plate 160 during a rotation.

The straight-protrusion coupling hole 142 formed through the first end of the link 140 is coupled to the straight protrusion 133 extending to protrude from the coupling shaft 132 of the rotating shaft 130, while the coupling hole 143 formed through the second end of the link is coupled to the link coupler 154 of the power ring 150 by riveting or screwing.

Figure 9:
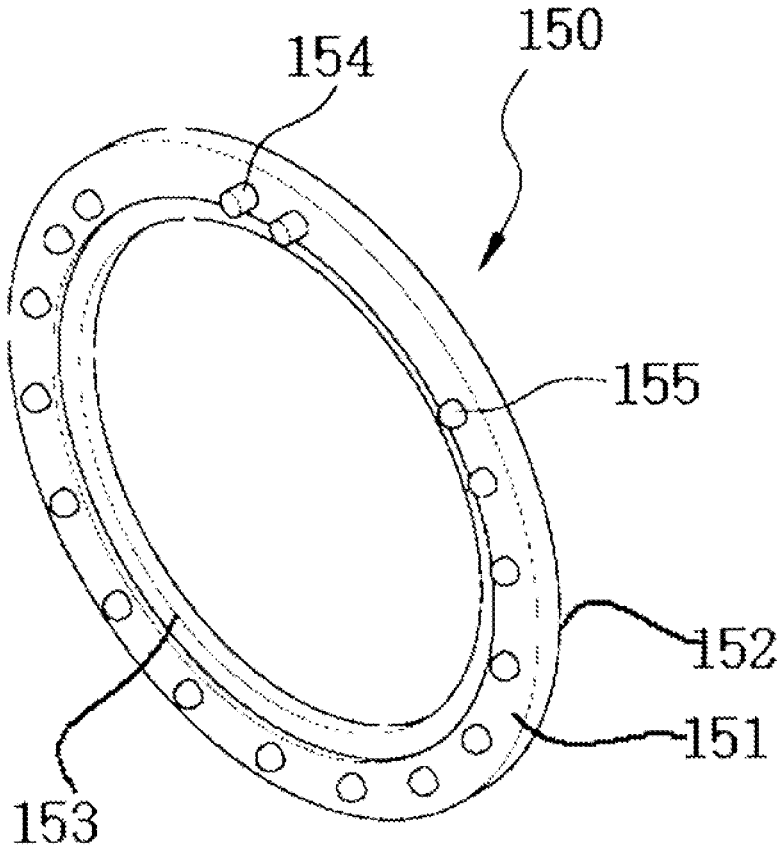
FIG. 9 is a perspective view showing the power ring 150.

FIG. 9 is a perspective view of the power ring 150.

As shown in FIG. 9 and FIG. 6(1), the power ring 150 is formed to have the shape of a plate-shaped ring with an inner surface 151 and an outer surface 152, and includes a circular rotation guide 153 that is provided on an inner circumference thereof to form a step relative to the outer surface 152 of the plate-shaped ring and extend integrally towards a central portion.

The power ring 150 includes a link coupler 154 provided on a region of the inner surface 151, and a plurality of hemispherical power protrusions 155 provided on regions of the inner surface 151 other than the region having the link coupler 154 and protruding to a predetermined height to correspond to the number of the power protrusion inlet/outlet holes 208 formed in the bottom surface of the body hook 200.

The power ring 150 is formed integrally with the power protrusion 155 by compression, or by casting and heat treatment, or by punching a power-protrusion fastening hole (not shown) along a circumference and press-fitting the power protrusion 155 subjected to heat treatment into the power-protrusion fastening hole (not shown).

The power ring 150 is coupled with the rotating shaft 130 via the link 140, so that, if the rotating shaft 130 rotates, the power ring rotates together with the rotating shaft and provides the rotating power to the body hook 200 by the hemispherical power protrusions 155 secured to the inner surface 151.

The power ring 150 is integrally coupled with the rotating shaft 130, the link 140, and the fixed plate 160 for the convenience of the coupling process, thus constituting the second coupling body of FIG. 10.

Further, the power protrusion 155 has a hemispherical shape to protrude from the inner surface of the power ring 150 to a predetermined height.

Preferably, the power protrusions 155 are provided on the inner surface of the power ring 150 to form a bilateral symmetry with respect to the power protrusion 155 secured to the lowermost end on the inner surface of the power ring 150.

Since the power protrusion 155 has the shape of a hemisphere that is rounded at an end thereof, the power protrusion can smoothly slide over the power protrusion inlet/outlet hole 208 formed through the bottom surface of the body hook 200 to be freely coupled thereto or removed therefrom.

Here, an inlet of the power protrusion inlet/outlet hole 208 on an outer bottom surface of the body hook 200 is preferably ground to allow the hemispherical power protrusion 155 of the power ring 150 to be smoothly slid and thereby facilitate insertion and removal.

The protruding height of the hemispherical power protrusion 155 is set to a height at which the power protrusion does not protrude into the under-thread receiving portion 207 that is the body of the body hook 200 when it being coupled to the power protrusion inlet/outlet hole 208 of the outer bottom surface of the body hook 200.

Thus, the hemispherical power protrusion 155 is formed not to be longer than the thickness of a material of the bottom plate of the body hook 200, and is preferably formed to be identical with the thickness of the material of the bottom plate of the body hook 200.

Next, FIG. 10 is a view illustrating the first coupling body C1 and the second coupling body C2 in the coupling process integrally coupled with the fixed plate 160.

The fixed plate 160 integrally includes, by compressing a circular steel plate, a rotating-shaft receiving portion 161 provided on a central portion thereof, a receiving-shaft receiving portion 162 provided on a coupling region with the receiving shaft 120, a rotation-guide guiding portion 163 provided on an outer circumference thereof, and a compressing portion 164 provided on the central region thereof.

In the fixed plate 160, a rotating-shaft coupling hole 161' is formed through the central portion of the rotating-shaft receiving portion 161, a receiving-shaft coupling hole 162' is formed through the central portion of the receiving-shaft receiving portion 162, and a plurality of fastening holes 165 each having a nut structure is formed through the compressing portion 164 to correspond to the positions of the fixed-plate fixing holes 114 formed in the housing 110, with the fastening bolts 166 provided in the fastening holes 165, respectively.

The fixed plate 160 rotatably couples the receiving shaft 120, the rotating shaft 130 and the power ring 160 to the inner surface of the closed spherical surface 110*b* of the housing 110, respectively, in such a way as to be fastened to the inner surface of the closed spherical surface 110*b* of the housing 110 via a fastening bolt 156.

The fixed plate 160 integrally constitutes the first coupling body C1, as shown in FIG. 10, by inserting the coupling shaft 132 of the rotating shaft 130, which has the straight protrusion 133 protruding therefrom for the purpose of convenient coupling of the power actuator 100, into the rotating-shaft coupling hole 161' of the rotating-shaft receiving portion 161 at a first surface of the fixed plate 160, and press-fitting the straight protrusion 133, protruding to a second surface of the fixed plate 160, into the straight-protrusion coupling hole 142 formed in a first end of the link 140.

Further, a second coupling body C2 is integrally constituted, as shown in FIG. 10, by riveting or screwing the link coupler 154 of the power ring 150 to the coupling hole 143 formed in a second end of the link 140 of the first coupling body C1

In order to constitute the power actuator 100, first, the receiving shaft 120 is seated in the receiving-shaft receiving portion 112 of the housing 110. Subsequently, in order to allow the gear driving between the transmission gear 122 of the receiving shaft 120 and the rotary gear 131 of the rotating shaft 130 of the second coupling body C2, both the gears are seated on the second coupling body C2 in the housing 110 in such a way as to engage with each other. Thereafter, the fastening bolts 166 are fastened to the fastening holes 165 of the fixed plate 160. In this way, the power actuator 100 has been integrally configured.

The power actuator 100 configured as such transmits power received in the receiving shaft 120 from the power transmission shaft (not shown) of the conventional sewing machine to the rotating shaft 130 by the gear driving, so that the rotation of the rotating shaft 130 causes the power ring 150 coupled to the rotating shaft 130 via the link 140 to rotate.

Figure 11:
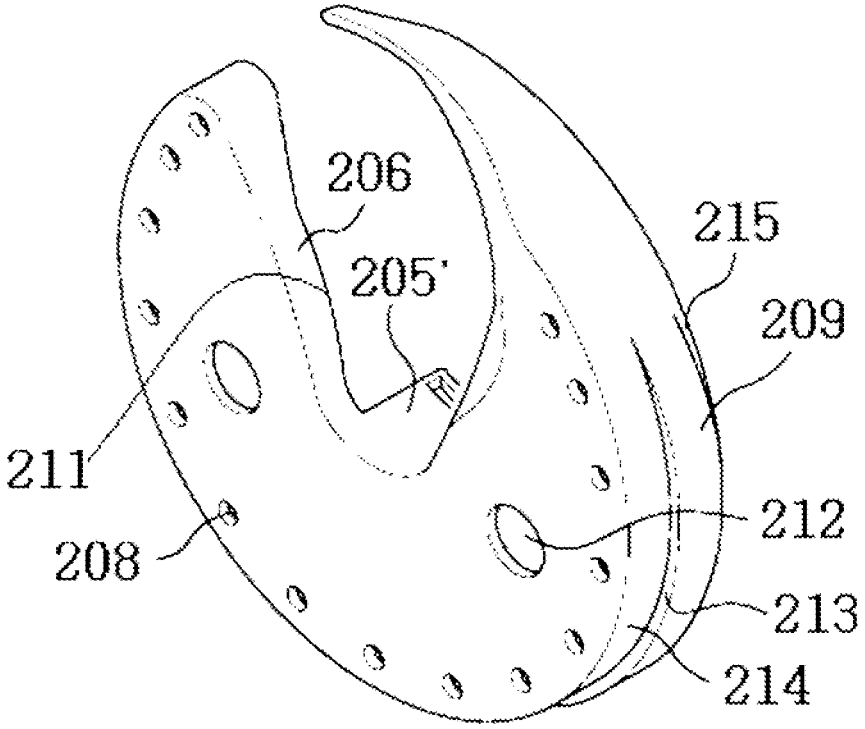
FIG. 11 is a perspective view showing the body hook.
Figure 12:
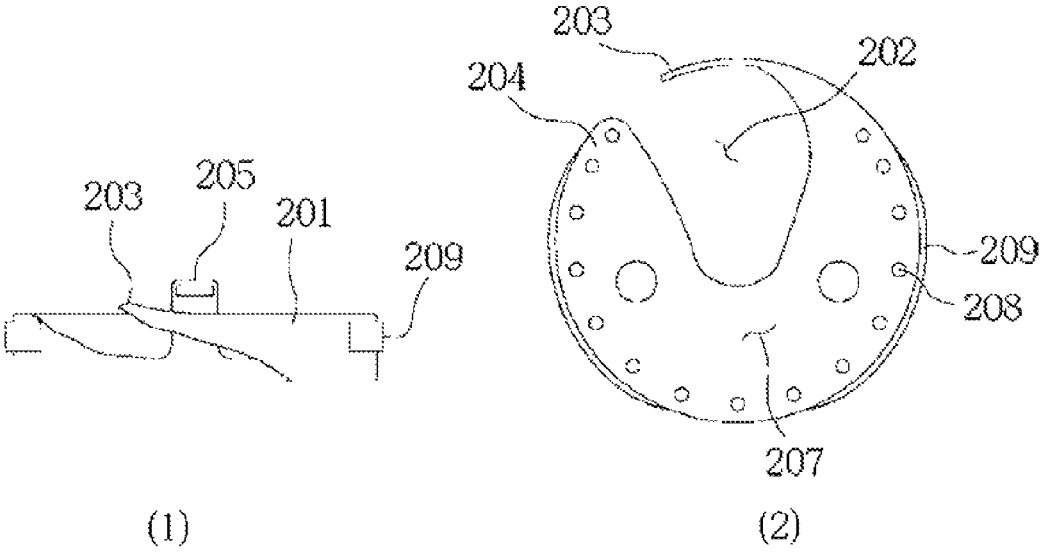
FIG. 12 illustrates the body hook in a side view and a plan view.

FIG. 11 is a perspective view showing the body hook, and FIG. 12 illustrates the body hook in a side view and a plan view.

As shown in FIG. 4(2), FIGS. 11 and 12, the body hook 200 integrally includes a cavity 202 formed by cutting a cylindrical body of a predetermined height, which is open at a surface thereof, from a side of an outer circumference 201 to a point beyond a central point of the rotating shaft 130 provided in a central region, a lanceolate-shaped hook 203 formed on a first end of the cut outer circumference 201, a rear portion 204 formed on a second end of the cut outer circumference 201, a binding bar 205 formed by rectangularly cutting a lower region of a center on a cut bottom surface and bending it upwards, a wall 206 formed by bending both sides of the cut bottom surface upwards, an under-thread receiving portion 207 defined by the outer circumference 201, the binding bar 205 and the wall 206 to serve as a body, a plurality of power protrusion inlet/outlet holes 208 formed to correspond to the number of hemispherical power protrusions 155 that are formed on the power ring 150 along an outer periphery of the bottom surface, and a plurality of projecting bars 209 having a predetermined width and length and provided along an outer circumference 201 of the body hook in such a way as to project from an inside towards an outside in a row.

Referring to FIG. 4(1), the outer diameter of the body hook 200 is formed to have a size of a circle that is circumscribed about a central point h on an upper end of an inner diameter of the prior hook body c that has the central point e on the lower end of the outer diameter of the prior hook body c as the central point of the rotating shaft 130. As shown in FIG. 4(2), the outer diameter of the body hook is set such that the body hook is rotatably inserted into an inner diameter portion of the housing 110.

Since the basic structure of the prior sewing machine is not changed, the upper-thread loop 12' is formed at the same position as the prior art. Thus, in order to allow the hook 203 to be naturally rotated with the upper-thread loop 12' being caught by the hook when the body hook 200 rotates, the hook 201 of the body hook 200 is formed as the same position as the hook of the conventional hook body. That is, as shown in FIG. 12(1), the hook protrudes slightly outwards from the opening 210 of the body hook 200.

To be more specific, as shown in FIG. 4(2), FIGS. 11 and 12, the body hook 200 includes the cavity 202 formed by cutting the cylindrical body of a predetermined height, which is open at a surface thereof, from a side of the outer circumference 201 to a point beyond a central point of the rotating shaft 130 provided in the central region. The lanceolate-shaped hook 203 is formed on the first end of the cut outer circumference 201, and the rear portion 204 is formed on the second end of the cut outer circumference 201.

As shown in FIG. 4(2) and FIG. 11, the cavity 202 is formed in an area which is sufficient to prevent the binding bar 205 and the end of the link 140 linked to the rotating shaft 130 of the second coupling body C2 from interfering with each other.

Further, the binding bar 205 is formed by rectangularly cutting the lower region of the center on the cut portion and bending it upwards, and the wall 206 is formed by bending both sides of the cut portion upwards.

Here, the binding bar 205 is spaced apart from the end of the link 140 coupled to the rotating shaft 130.

Further, the upper end of the wall 206 is ground to allow the upper-thread loop 12' to be smoothly slid when the body hook 200 passes through the upper-thread loop 12', thus forming an upper-thread sliding line 211. The hook 203 and the outer surface of the rear portion 204 are also ground to allow the upper-thread loop 12' to be smoothly slid.

The binding bar 205 and the wall 206 form the under-thread receiving portion 207 that is the body, together with the outer circumference 201.

Further, as shown in FIG. 11, the plurality of power protrusion inlet/outlet holes 208 is formed through the outer periphery on the bottom surface of the body hook 200 to correspond to the number of the hemispherical power protrusions 155 formed on the power ring 150.

The inlet of the power protrusion inlet/outlet hole 208 on the outer bottom surface of the body hook 200 is preferably ground to allow the hemispherical power protrusion 155 of the power ring 150 to be smoothly slid and thereby facilitate insertion and removal.

Further, a plurality of weight-reduction holes 212 is preferably formed through the bottom surface of the body hook 200 for the purpose of cooling and weight reduction.

As shown in FIGS. 11 and 12, the body hook 200 includes the plurality of projecting bars 209 that have a predetermined width and length and are provided along the outer circumference 201 of the body hook in such a way as to project from the inside towards the outside in a row.

Steps 213 are formed on both sides of the projecting bar 209. The outer circumference of one side of the step 213 forms a housing inserting portion 214, while the outer circumference of the other side of the step 213 forms a coupling-flange holding portion 215.

The maximum protruding height of the projecting bar 209 is identical with the thickness of the material forming the outer circumference 110*a* of the housing 110, so that the maximum outer diameter of the projecting bar 209 is identical with the outer diameter of the opening end 119 of the housing 110 of FIG. 3.

Figure 17:
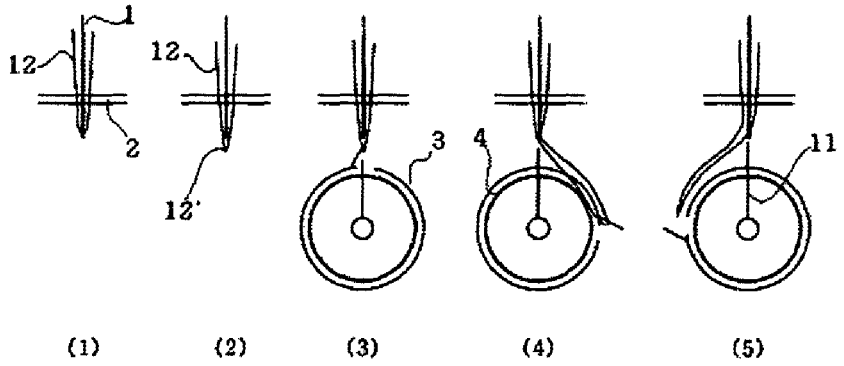
FIG. 17 is a view illustrating a sewing process using a rotary shuttle device that is a conventional under-thread supply device for a sewing machine.

The maximum sectional circumference of the under-thread receiving portion 207 that is the body of the body hook 200 is formed not to be more than a length of the upper thread extending when the upper-thread loop 12' turns around the prior bobbin case base (see FIG. 17(4)) and goes out in the conventional under-thread supply device for the sewing machine.

That is, since the gap should be formed between the binding bar 205 of the body hook 200 and the end of the link 140 coupled to the rotating shaft 130, the width of the body of the body hook 200 is formed not so as to exceed the central point of the rotating shaft 130 from the outer circumference 110*a* of one side of the housing 110. Thus, the maximum sectional circumference of the body of the body hook 200 is formed not to be more than the length of the upper thread extending when the upper-thread loop 12' turns around the prior bobbin case base and goes out in the conventional under-thread supply device for the sewing machine.

Therefore, the upper thread of a predetermined length supplied under the optimized condition of the conventional sewing machine has a certain surplus portion to be loosened. Hence, even if the thread is taken up, the tension of the upper thread pulling the strands of the cloth that is the sewn product is absorbed by the loosened upper thread, thus reducing the puckering of the sewn product.

Further, the body hook 200 configured as such receives the under thread 11 in the under-thread receiving portion 207 and is rotated about the rotating shaft 130 by the power actuator 100, so that the body hook passes through the upper-thread loop 12' sequentially from the hook 203 to the rear portion 204 while being rotated with it spaced apart from the power protrusion 155 in the upper region on the center of the housing 110, thus interweaving the under thread 11 with the upper thread 12.

That is, the body hook 200 receiving the under thread 11 receives the rotating power from the power ring 150 while the power protrusion 155 is rotatably coupled to the power protrusion inlet/outlet hole 208 in the lower region on the center of the housing 110 and the power ring 150 rotatably facing the outer bottom surface, and the body hook passes freely through the upper-thread loop 12' sequentially from the hook 203 to the rear portion 204 without interference while the power protrusion 155 is rotated with it being removed from and spaced apart from the power protrusion inlet/outlet hole 208 in the upper region on the center of the housing 110, thus interweaving the under thread 11 with the upper thread 12.

Figure 13:
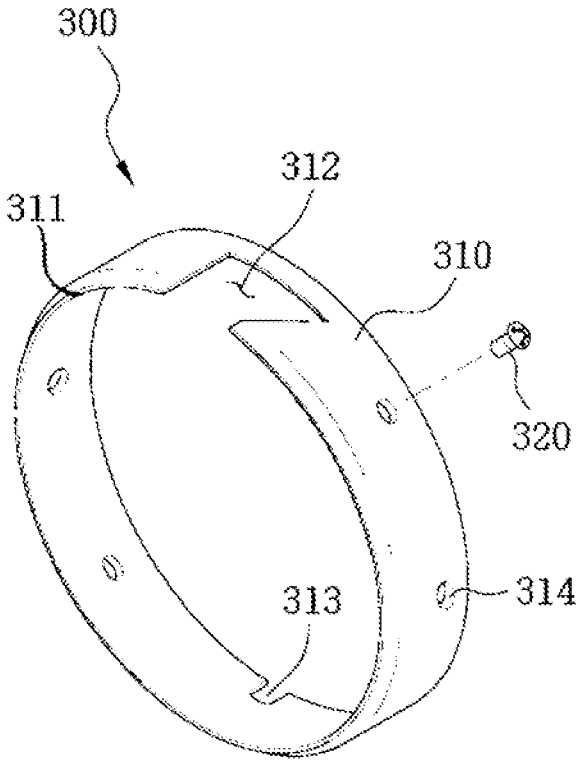
FIG. 13 is a perspective view showing a coupling member.

FIG. 13 is a perspective view showing the coupling member.

As shown in FIG. 13, the coupling member 300 of the hook unit 1 includes a coupling flange 310 and a coupling bolt 320.

The coupling flange 310 has the shape of a pipe that is open at both ends thereof, and integrally includes a locking step 311 curved at an end thereof towards a central portion, an upper-thread gate 312 formed by cutting an upper region of a center on the coupling flange to a predetermined width as shown in FIG. 13, a fixing-protrusion inserting recess 313 formed by cutting a lower region of a center on a second end of the coupling flange to a predetermined width, and a plurality of coupling holes 314 formed through an outer circumference of the coupling flange, each of the coupling holes having a nut structure therein. The coupling bolt 320 is provided in each of the coupling holes 314.

Here, the coupling bolt 320 is formed not to be more than the sum of the thickness of the material forming the coupling flange 310 and the thickness of the material forming the outer circumference 110*b* of the housing 110, such that the end of the bolt does not protrude into the housing 110. Preferably, the length of the coupling bolt is equal to the sum of the thicknesses.

The hook unit 1 of the under-thread supply device A for the sewing machine according to the present invention is integrally configured by the following process. First, the body hook 200 is seated by inserting the power protrusion 155 of the power ring 150 in the housing 110 of the power actuator 100 into the associated power protrusion inlet/outlet hole 208 provided on the outer portion of the bottom surface of the body hook 200 via the above-described members. Next, the fixing protrusion 117 protruding from the lower portion on the center of the outer circumference 110*a* of the housing 11 is inserted into the fixing-protrusion inserting recess 313 of the coupling flange 310, so that the coupling of the coupling flange 310 is achieved. Thereafter, the coupling bolt 320 is fastened to each coupling hole 314 formed in the outer circumference of the coupling flange 310.

Figure 14:
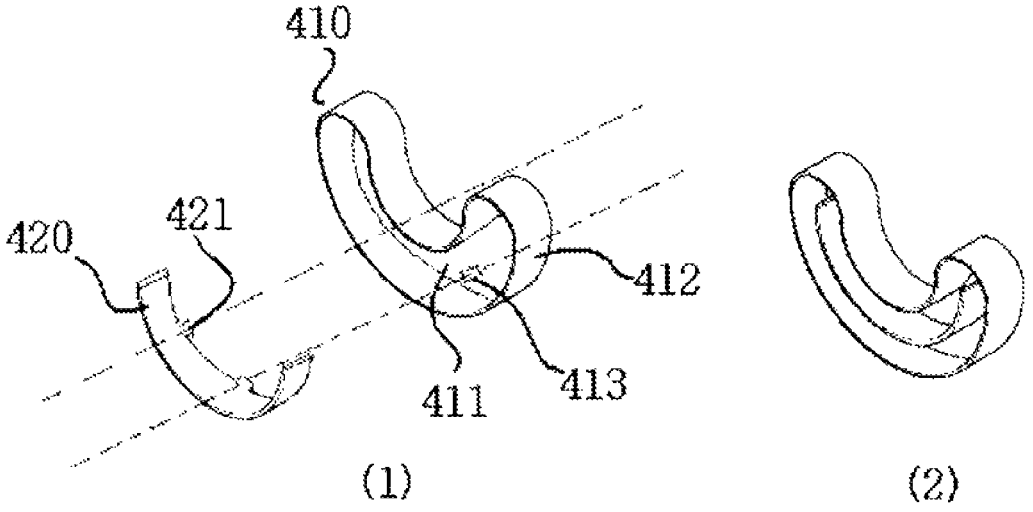
FIG. 14 is a view illustrating an U-shaped bobbin.
Figure 15:
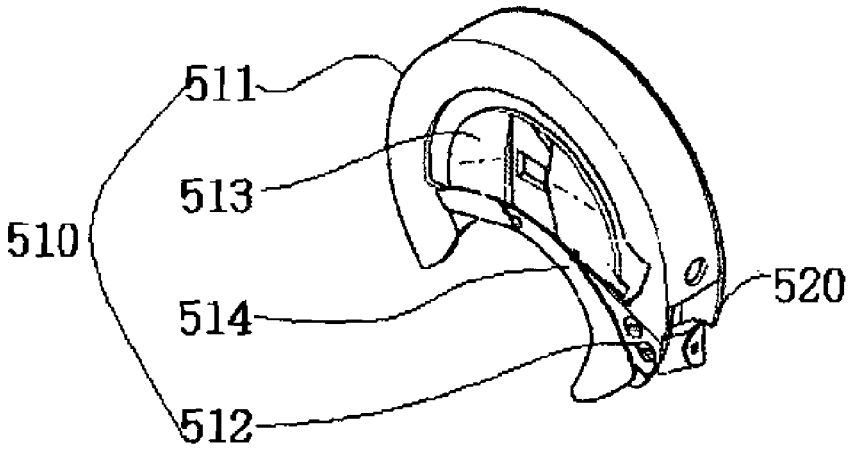
FIG. 15 is a view illustrating an U-shaped bobbin case.
Figure 16:
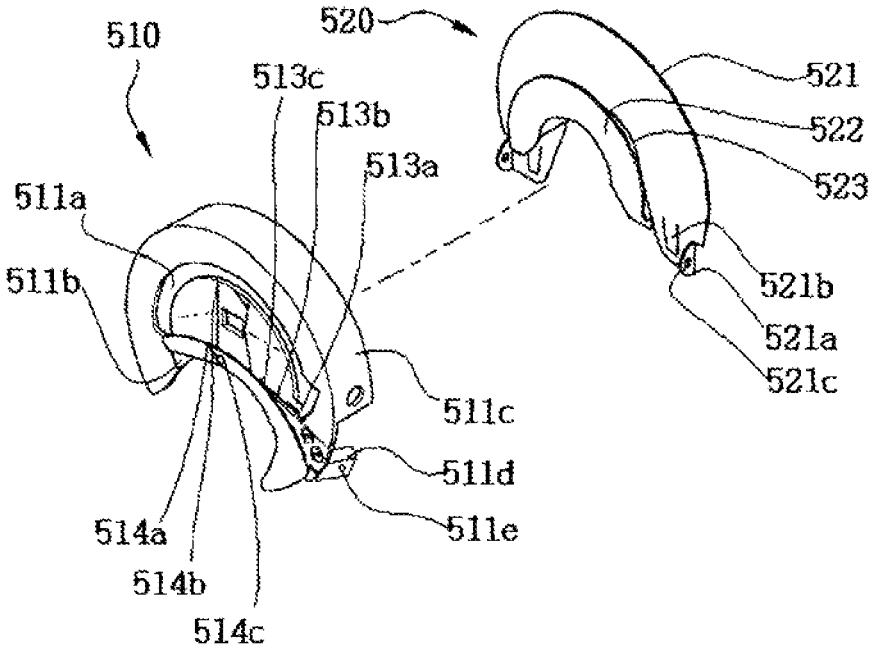
FIG. 16 is an exploded perspective view showing the U-shaped bobbin case.

FIG. 14 is a view illustrating an U-shaped bobbin, and FIGS. 15 and 16 are views illustrating an U-shaped bobbin case.

As shown in FIGS. 14 to 16, the under-thread unit 2 of the under-thread supply device A for the sewing machine includes an U-shaped bobbin 400 seating the under-thread bundle 11' therein and mounted in the U-shaped bobbin case 500, and the U-shaped bobbin case 500 accommodating the U-shaped bobbin 400 in which the under-thread bundle 11' is seated, and inserted into the under-thread receiving portion 207 of the body hook 200.

Figure 18:
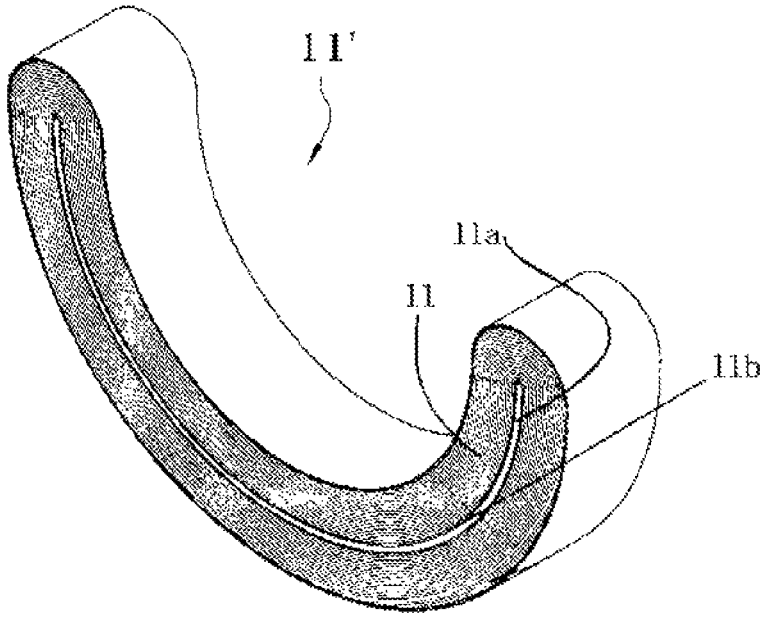
FIG. 18 is a reference view of an under-thread bundle.

As shown in FIG. 18, the under-thread bundle 11' is prepared in an U shape to be accommodated in the U-shaped bobbin 400 by winding a predetermined amount of under thread 11 around the winding shaft 11*a* having the shape of a soft pipe with a predetermined width and compressing a side of the under thread using a compressor to correspond to the shape of the U-shaped bobbin 400.

As shown in FIG. 14, the U-shaped bobbin 400 includes an U-shaped body 410 and an under-thread-bundle seating wall 420. The U-shaped body 410 is made of a steel material or a synthetic resin material, and integrally includes an U-shaped bottom plate 411 having one or two seating-wall coupling holes 413 formed therethrough, and an outer wall 412 erected upwards along an edge of the bottom plate 411. The under-thread-bundle seating wall 420 integrally has on a lower side thereof coupling protrusions 421 to correspond to the number of the formed seating-wall coupling holes 413, and is detachably provided on the bottom plate 411.

The winding shaft 11*a* is removed from the under-thread bundle 11' and then the under-thread-bundle seating wall 420 is inserted into a place from which the winding shaft has been removed. Thereby, the coupling protrusion 421 of the under-thread-bundle seating wall 420 is fitted into the seating-wall coupling hole 413 formed through the bottom plate 411 in the U-shaped bobbin 400, so that the under-thread bundle 11' is reliably seated in the U-shaped bobbin 400.

Here, the under-thread-bundle seating wall 420 may be omitted, and only the under-thread bundle 11' may be directly mounted in the U-shaped bobbin 400.

Next, as shown in FIGS. 15 and 16, the U-shaped bobbin case 500 is made of a steel material, has a size that is inserted into the body hook 200 and is formed in the U shape. The bobbin case includes a left case 510 and a right case 520 which are separately manufactured but are integrally assembled with each other by hinge coupling.

As shown in FIG. 16, the left case 510 integrally includes a left cover 511, a tension adjusting piece 512, a binding portion 513, and an under-thread-discharge-hole aligning bar 514. The left cover is formed to have a shape of a half moon that is recessed at a region thereof, and includes an U-shaped elongated hole 511*a* formed through a central region thereof, thus defining a member coupling portion 511*b* towards a recessed portion, a protective wall 511*c* of a predetermined length integrally welded upwards along an outer arc thereof, and a hinge protrusion 511*d* welded to each of both ends of an inner surface thereof, with a hinge-shaft coupling hole 511*e* formed through the hinge protrusion. The tension adjusting piece comprises a plate spring, and is screwed to an end portion on an outer surface of the left cover 511. The binding portion includes a lower planar portion and an upper curved portion. The lower planar portion is welded to an outer surface of the member coupling portion 511*b*, and the upper curved portion integrally includes an under-thread guide piece 513*a* integrally formed or welded to an edge adjacent to the tension adjusting piece 512, an elongate under-thread guide groove 513*b* provided adjacent to a surface of the under-thread guide piece 513*a* and extending to a lower region of the tension adjusting piece 512 towards a central portion, and an under-thread stopping hole 513*c* formed in an end of the elongate under-thread guide groove 513*b*. The under-thread-discharge-hole aligning bar 514 has on a central portion thereof an under-thread discharge hole 514*c*, an under-thread guide pin 514*a*, and an under-thread guide groove 514*b*, and is formed in a shape of a curved bar to correspond to a curved shape of the recessed portion. A first end of the under-thread-discharge-hole aligning bar is welded to a first end of the outer surface of the left cover 511, and a second end thereof is welded to a second end of the curved portion of the binding portion 513 across the first end of the outer surface of the left cover 511 and the second end of the curved portion of the binding portion 513 along the recessed portion.

The lower planar portion of the binding portion 513 and the outer surface of the member coupling portion 511*b* form a joining layer (not shown) that is one to five times as thick as the under thread, by a welding material.

A lower surface of the binding portion 513 is joined to an upper portion spaced apart from the member coupling portion 511*b* by a thickness of the joining layer (not shown) via the joining layer (not shown). Thereby, the lower planar portion of the binding portion 513 and the outer surface of the member coupling portion 511*b* form a step corresponding to the thickness of the joining layer (not shown). As a result, the under thread 11 of the under-thread bundle 11' mounted therein can be smoothly unwound and supplied without interference through the above-described step and the U-shaped elongated hole 511*a*, thus making it easy to adjust the tension of the under thread.

Further, as shown in FIG. 16, the right case 520 integrally includes a right cover 521, an under-thread-bundle protective wall 522, and a seating portion 523. The right cover 521 is formed to have a shape of a half moon that is recessed at a region thereof to correspond to a shape of the left cover 511, and integrally includes a bent portion 521*a* formed by cutting each of both ends of an outer periphery thereof to a predetermined width and then bending a cut end upwards, and an elastic piece 521*b* formed by cutting a central portion of each of the both ends to a predetermined width to have a "⊏" shape and then upwardly inclining the cut portion at a predetermined angle, a hinge shaft 521*c* of a hollow portion being welded to a central portion of the bent portion 521*a*, a recessed portion being welded to an outer curved side of the seating portion 523. The under-thread-bundle protective wall is formed in a size smaller than that of the right cover 521 while having a shape corresponding to that of the right cover, and is welded to an inner curved side of the seating portion 523. The seating portion has a predetermined width and is formed in an U shape, the right cover 521 being welded to an outer curved side of the seating portion and the under-thread-bundle protective wall 522 being welded to an inner curved side thereof.

The U-shaped bobbin 400 or the under-thread bundle 11' is seated between the right cover 521 and the under-thread-bundle protective wall 522 in the right case 520.

The U-shaped bobbin case 500 is configured as an integral structure by inserting the hinge shaft 521*c* of the bent portion 521*a* of the right case 520 into the hinge-shaft coupling hole 511*e* of the hinge protrusion 511*d* of the left case 510.

After the right case 520 of the U-shaped bobbin case 500 is opened, the U-shaped bobbin 400 is mounted therein with the under-thread bundle 11' seated in the seating portion 523. Thereafter, the right case 520 is closed. Then, the right case 520 is closed while being in close contact with the left case 510 by a restoring force of the elastic piece 521*b* of the right case 520, so that the U-shaped bobbin 400 is safely mounted in the bobbin case 500.

Here, the U-shaped bobbin 400 mounted in the U-shaped bobbin case 500 may be omitted, and only the under-thread bundle 11' may be directly mounted in the U-shaped bobbin case 500.

Hereinbelow, the operation of the hook unit 1 and the under-thread unit 2 of the under-thread supply device A for the sewing machine according to the present invention will be described in detail.

First, the coupling shaft 132 of the rotating shaft 130 having the straight protrusion 133 protruding therefrom is inserted and accommodated into the rotating-shaft coupling hole 161' of the rotating-shaft receiving portion 161 of the fixed plate 160 at the first surface of the fixed plate 160. The straight protrusion 133 protruding to the second surface is fixedly press-fitted into the straight-protrusion coupling hole 142 formed in the first end of the link 140. Thereby, the rotating shaft 130 and the link 140 constitute the first coupling body C1 to be integrated with the fixed plate 160.

Next, the link coupler 154 of the power ring 150 is riveted or screwed to the coupling hole 143 formed in the second end of the link 140 of the first coupling body C1, so that the power ring 150 and the first coupling body C1 integrally constitute the second coupling body C2.

Subsequently, after the receiving shaft 120 is seated in the receiving-shaft receiving portion 112 in the housing 110, the transmission gear 122 of the receiving shaft 120 and the rotary gear 131 of the rotating shaft 130 are seated in the second coupling body C2 in such a way that the teeth of both of them engage with each other to permit the gear driving. The fastening bolt 166 is secured to the fastening hole 165 of the fixed plate 160. Thereby, the configuration of the power actuator 100 is completed as the integrated structure.

In the power actuator 100 configured as such, the power ring 150 of the second coupling body C2 is secured to the inner surface of the closed spherical surface 110*b* of the housing 110 to be parallel thereto. The outer circumference 110*a* of the housing 110 is formed to have a difference corresponding to the height of the power protrusion 155 in the central regions of the upper and lower portions. Thus, if the housing inserting portion 214 of the body hook 200 is inserted into the opening 110*c* of the housing 110, the power protrusion inlet/outlet hole 208 on the bottom surface of the body hook 200 is coupled to the power protrusion 155, at the lower portion of the central region of the housing 110, while the power protrusion inlet/outlet hole 208 on the bottom surface of the body hook 200 is separated from the power protrusion 155, at the upper portion of the central region of the housing 110.

Next, after the body hook 200 is seated by inserting the hemispherical power protrusion 155 of the inner power ring 150 of the power actuator 100 into the power protrusion inlet/outlet hole 208 formed in the outer portion of the bottom surface of the body hook 200, the fixing protrusion 117 protruding from the lower portion on the center of the outer circumference 110*a* of the housing 110 is inserted into the fixing-protrusion inserting recess 313 of the coupling flange 310, so that the coupling flange 310 is assembled. Further, by fastening the coupling bolt 320 to each coupling hole 314 on the outer circumference of the coupling flange 310, the assembly of the hook unit 1 of the under-thread supply device A for the sewing machine according to the present invention has been completed.

The hook unit 1 of the under-thread supply device A for the sewing machine according to the present invention configured as such is coupled by inserting the end of the power transmission shaft (not shown) of the conventional sewing machine into the hollow portion 121 of the receiving shaft 120 of the power actuator 100, and is mounted to the lower portion of the toothed-portion moving member (not shown) in the bed portion of the conventional sewing machine by a known fixing means (not shown) that surrounds the outer circumference of the coupling flange 310.

Next, the U-shaped bobbin case 500 accommodating therein the U-shaped bobbin 400 in which the under-thread bundle 11' is seated is inserted into the under-thread receiving portion 205 that is the body of the body hook 200 of the power actuator 100, and then is bound by the binding bar 205. Thereby, the sewing machine is ready to sew.

If power is transmitted from the power transmission shaft (not shown) of the conventional sewing machine to the receiving shaft (120) of the power actuator (100), power received by the receiving shaft 120 is transmitted to the rotating shaft 130 through the gear driving, so that the rotating shaft 130 is rotated. The rotation of the rotation shaft results in rotating the power ring 150 coupled to the coupling shaft 132 of the rotating shaft 130 via the link 140.

As the power ring 150 rotates as such, in the lower region of the rotating shaft 130, the hemispherical power protrusion 155 protruding from a surface is rotatably coupled to the power protrusion inlet/outlet hole 208 formed through the bottom surface of the body hook 200, thus rotating the body hook 200.

As the body hook 200 rotates as such, in the upper region of the rotating shaft 130, the hemispherical power protrusion 155 is removed from the power protrusion inlet/outlet hole 208, so that the body hook 200 is rotated with it being separated from the power protrusion 155 of the power ring 150.

When the body hook 200 rotating in the separated state as such moves from the hook 203 to the rear portion 204, it sequentially passes through the upper-thread loop 12' to interweave the under thread 11 with the upper thread 12. The thread take-up process is followed. Therefore, the stitch is formed on the sewn product.

To be more specific, as shown in FIGS. 5 and 6, the outer circumference 110*a* of the housing 110 is formed by welding facing ends to each other, the ends being formed in the elliptical shape by cutting along the diagonal lines that are formed on the left and right sides of the upper-side intersection of the perpendicular line relative to the ½ point in the horizontal direction of the outer circumference 110*a* at the half of the angle a between the surface of forming the power protrusion 155 of the power ring 150 and the line connecting the joining point of the power protrusion 155 located at the lowermost position of the power ring 150 with the upper end of the power protrusion 155 located at the central position of the power ring 150, at the joining point of the power protrusion 155 secured to the lowermost position of the power ring 150.

The plurality of projecting bars 209, each having a predetermined width and length, are formed outwards from the outer circumference 201 of the body hook 200 in a row along the outer circumference 201.

The body hook 200 is rotated with the step 213 of the body hook 200 supported by the opening end 119 of the housing 110, when the housing inserting portion 214 is inserted and rotated in the opening 110*c* of the housing 110.

At this time, since the opening end 119 of the housing 110 maintains a circular shape, the body hook 200 rotates along a predetermined circle.

However, from the central portion of the housing 110, the hemispherical power protrusion 155 is removed from the power protrusion inlet/outlet hole 208 of the body hook 200. Thus, in the upper region on the center of the housing 110, the body hook 200 is rotated with the bottom surface thereof separated from the power protrusion 155 of the power ring 150.

As such, the body hook 200 rotated in the separated state passes sequentially through the upper-thread loop 12' freely without interference from the hook 203 to the rear portion 204 to interweave the under thread 11 with the upper thread 12. Thereafter, the thread take-up process is performed to form the stitch on the sewn product, and the toothed portion pushes it to a predetermined width. While such a process is repeated again, the sewing operation is implemented.

Meanwhile, the operation of the under-thread unit 2 is as follows.

As shown in FIG. 18, the end of thread 11*b* is present at the inside and outside of the under-thread bundle 11' accommodated in the U-shaped bobbin case 500. The inside thread end is pulled through the U-shaped elongated hole 511*a* of the left case 510, is hung on the under-thread guide piece 514*b*, is guided along the elongate under-thread guide groove 513*b* formed in the lower region of the tension adjusting piece 512 and then is stopped in the under-thread stopping hole 513*c*. Here, it is possible to use the outside thread end.

When a user starts sewing, the under thread 11 stopped in the under-thread stopping hole 513*c* is hung on the under-thread guide pin 514*a* of the under-thread-discharge-hole aligning bar 514 and then is pulled, so that the under thread of a predetermined length is pulled out from the under-thread discharge hole 514*c* along the under-thread guide groove 514*b*. Thereafter, when a handle of the binding portion 513 is pulled, the binding bar 205 of the body hook 200 is inserted into the binding hole (not shown) of the binding portion (513), and then the handle is released, the U-shaped bobbin case 500 is safely bound to the under-thread receiving portion 207 of the body hook 200.

Next, a wheel (not shown; it is turned to move the needle and the thread take-up up and down) of the sewing machine is slightly turned, so that the needle of a needle bar moves down and then moves up. In such a state, the upper thread 12 moves up while catching the under thread 11. In such a state, the sewing operation is performed with the under thread 11 and the upper thread 12 drawn out to a predetermined length.

Although the embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An under-thread supply device for a sewing machine, comprising:

a hook unit comprising a body hook rotatably mounted therein, the body hook discharging an under thread and passing directly through an upper-thread loop to interweave the under thread with upper thread so as to form a stitch on a sewn product, the body hook having an under-thread receiving portion;

an under-thread unit comprising:

an U-shaped bobbin configured to hold an under-thread bundle compressed to have a U-shape so as to fit in the U-shaped bobbin; and an U-shaped bobbin case in the under-thread receiving portion, the u-shaped bobbin case configured the accommodate the U-shaped bobbin and the U-shaped under-thread bundle, configured to supply the under thread for forming the stitch on the sewn product.

2. The under-thread supply device according to claim 1, wherein the hook unit further comprises:

a power actuator configured to receive power from a conventional sewing machine, the power actuator comprising:

a rotating shaft rotatable by gear driving using a rotational power transmitted from the power actuator;

a power ring coupled with the rotating shaft configured to transmit the rotational power; and a link configured to couple the power ring and the rotating shaft; and a coupling member configured to couple the power actuator with the body hook, and the body hook rotatable by the rotational power transmitted from the power ring.

3. The under-thread supply device according to claim 2, wherein the hook unit further comprises a receiving shaft configured to transmit the power of the conventional sewing machine to the rotating shaft by the gear driving so that the rotation of the rotating shaft causes the power ring coupled to the rotating shaft via the link to rotate.

4. The under-thread supply device according to claim 2, wherein the body hook further comprises:

a cylindrical body of a predetermined height of an outer circumference and a bottom surface defined by a portion of the outer circumference;

a cavity opened in the bottom surface from a first end and a second end of the outer circumference to a point beyond a central point of the rotating shaft in a central region;

a lanceolate-shaped hook on the first end;

a rear portion on the second end;

a binding bar having a rectangular shape extending from the bottom surface toward a height direction from a rim of the cavity at a region beyond the central point of the rotating shaft;

a wall extending from the rim of the cavity toward the height direction extending from the binding bar to the first end and to the second end, respectively, the under-thread receiving portion being defined by the outer circumference, the bottom surface, the binding bar and the wall;

a plurality of power protrusion inlet/outlet holes corresponding to a number of hemispherical power protrusions on the power ring along an outer periphery of the bottom surface; and a plurality of projecting bars on an outer circumference of the cylindrical body, projecting from from an inside toward an outside of the cylindrical body in a row, and having a predetermined width and length.

5. The under-thread supply device according to claim 4, wherein a maximum sectional circumference of the under-thread receiving portion that is a body of the body hook is not more than a length of the upper thread extending when the upper-thread loop turns around a base of a prior bobbin case and goes out.

6. The under-thread supply device according to claim 2, wherein the body hook receives the under thread in the under-thread receiving portion and is rotated about the rotating shaft by coupling or decoupling between the power protrusion inlet/outlet holes on the bottom surface and the power protrusions of the power ring as the power actuator is driven, and in a lower region of a center of a housing, the power protrusions receive the rotating power from the power ring while being rotatably coupled to the power protrusion inlet/outlet holes, and in an upper region of the center of the housing, the power protrusions are removed from the power protrusion inlet/outlet holes and are rotated while being spaced apart so that the power protrusions pass through the upper-thread loop sequentially from the hook to the rear portion, interweaving the under thread with the upper thread.

7. The under-thread supply device according to claim 2, wherein the power actuator further comprises:

a housing;

a receiving shaft configured to transmit the power received from the conventional sewing machine to the rotating shaft;

a fixed plate configured to rotatably couple the receiving shaft, the rotating shaft, and the power ring in a closed spherical surface of the housing, wherein an outer diameter of the housing is maximized within a range where the housing is interfered by a toothed-portion moving member on a lower portion of a bed portion of the conventional sewing machine, the housing being a size of a circle that is circumscribed about a first central point on an upper end of an outer diameter of a prior hook body that has a second central point on a lower end of the outer diameter of the prior hook body as a central point of the rotating shaft.

8. The under-thread supply device according to claim 2, wherein the power actuator further comprises:

a housing;

a receiving shaft configured to transmit the power received from the conventional sewing machine;

a fixed plate configured to rotatably couple the rotating shaft, and the power ring, wherein the power ring further comprises hemispherical power protrusions configured to transmit the rotational power from the rotating shaft to the body hook.

9. The under-thread supply device according to claim 2, wherein the power actuator further comprises:

a housing comprising a lateral cylindrical body having an outer circumference of a predetermined height and a closed spherical surface defined by the outer circumference;

a receiving shaft configured to transmit the power received from the conventional sewing machine;

a fixed plate having fastening holes and configured to rotatably couple the receiving shaft, the rotating shaft, and the power ring, a rotating-shaft coupling hole penetrated in the closed spherical surface, a receiving-shaft receiving portion mounted on the closed spherical surface at a position where the power of the conventional sewing machine is received;

a receiving-shaft coupling hole through a central portion of the receiving-shaft receiving portion, the receiving-shaft coupling hole being overlapped with the rotating-shaft coupling hole;

a plurality of fixed-plate fixing holes each having a nut structure in the closed spherical surface corresponding to positions of the fastening holes in the fixed plate;

a plurality of coupling-flange coupling holes each having a nut structure, and through the outer circumference;

an upper-thread gate defined by a cut-out the outer circumference; and a fixing protrusion protruding from a lower portion on the center of the outer circumference, wherein the outer circumference of the housing is welded to have a trapezoidal cross-sectional shape after cutting the lateral cylindrical body along diagonal lines that connect an upper-side intersection of a perpendicular line relative to a ½ point in a horizontal direction of the outer circumference with intersections spaced apart from a lower-side intersection relative to opposite sides of the perpendicular line by a predetermined length.

10. The under-thread supply device according to claim 1, wherein the U-shaped bobbin further comprises an under-thread-bundle seating wall inserted in the under-thread bundle, and the under-thread-bundle seating wall is attached inside the U-shaped bobbin so as to secure the under-thread bundle in the U-shaped bobbin.

11. The under-thread supply device according to claim 9, wherein the housing comprises a metal.

* * * * *